United States Patent [19]

Justus

[11] Patent Number: 4,479,551

[45] Date of Patent: Oct. 30, 1984

[54] ACTUATOR FOR A HYDRAULIC IMPACT DEVICE

[75] Inventor: Edgar J. Justus, Beloit, Wis.

[73] Assignee: Hughes Tool Company, Houston, Tex.

[21] Appl. No.: 325,319

[22] Filed: Nov. 27, 1981

[51] Int. Cl.[3] ..... B25D 9/00

[52] U.S. Cl. ..... 173/119; 173/125; 173/112; 173/134

[58] Field of Search ..... 173/119, 17, 131, 134, 173/112, 116, 125

[56] References Cited

U.S. PATENT DOCUMENTS

| | | | |
|---|---|---|---|
| 2,894,724 | 7/1959 | Andrew | 173/119 |
| 3,431,985 | 3/1969 | Bowen | 173/119 |
| 3,456,741 | 7/1969 | James | 173/119 X |
| 3,687,008 | 8/1972 | Densmore | 91/25 X |
| 3,827,507 | 8/1974 | Lance | 173/15 X |
| 3,866,690 | 2/1975 | Lance | 173/15 X |
| 3,908,373 | 9/1975 | Peterson | 60/371 X |
| 3,925,985 | 12/1975 | Peterson | 60/371 X |
| 4,018,135 | 4/1977 | Lance | 91/321 X |
| 4,231,434 | 4/1980 | Justus | 173/119 |

FOREIGN PATENT DOCUMENTS

| | | | |
|---|---|---|---|
| 2072080 | 9/1981 | United Kingdom | 173/119 |

*Primary Examiner*—E. R. Kazenske
*Assistant Examiner*—Willmon Fridie, Jr.
*Attorney, Agent, or Firm*—Gerald A. Mathews

[57] ABSTRACT

A linear actuator includes a ram and a piston separated by a column of hydraulic fluid in a housing. Upward movement of the ram in the housing first seals a finite quantity of hydraulic fluid in the housing cavity. Continued upward ram movement then causes the piston, and hydraulic fluid beneath it, to move upwardly into a sealed gas chamber to compress a gas and create a source of potential energy. Release of the force moving the ram upwardly permits the compressed gas above the piston to expel the hydraulic fluid from the chamber against the ram thereby converting the potential energy in the compressed gas into kinetic energy in the ram. The hydraulic fluid bears directly against the ram to provide the working stroke of the impact device without the effect of metal fatigue from direct contact between the piston and ram.

6 Claims, 1 Drawing Figure

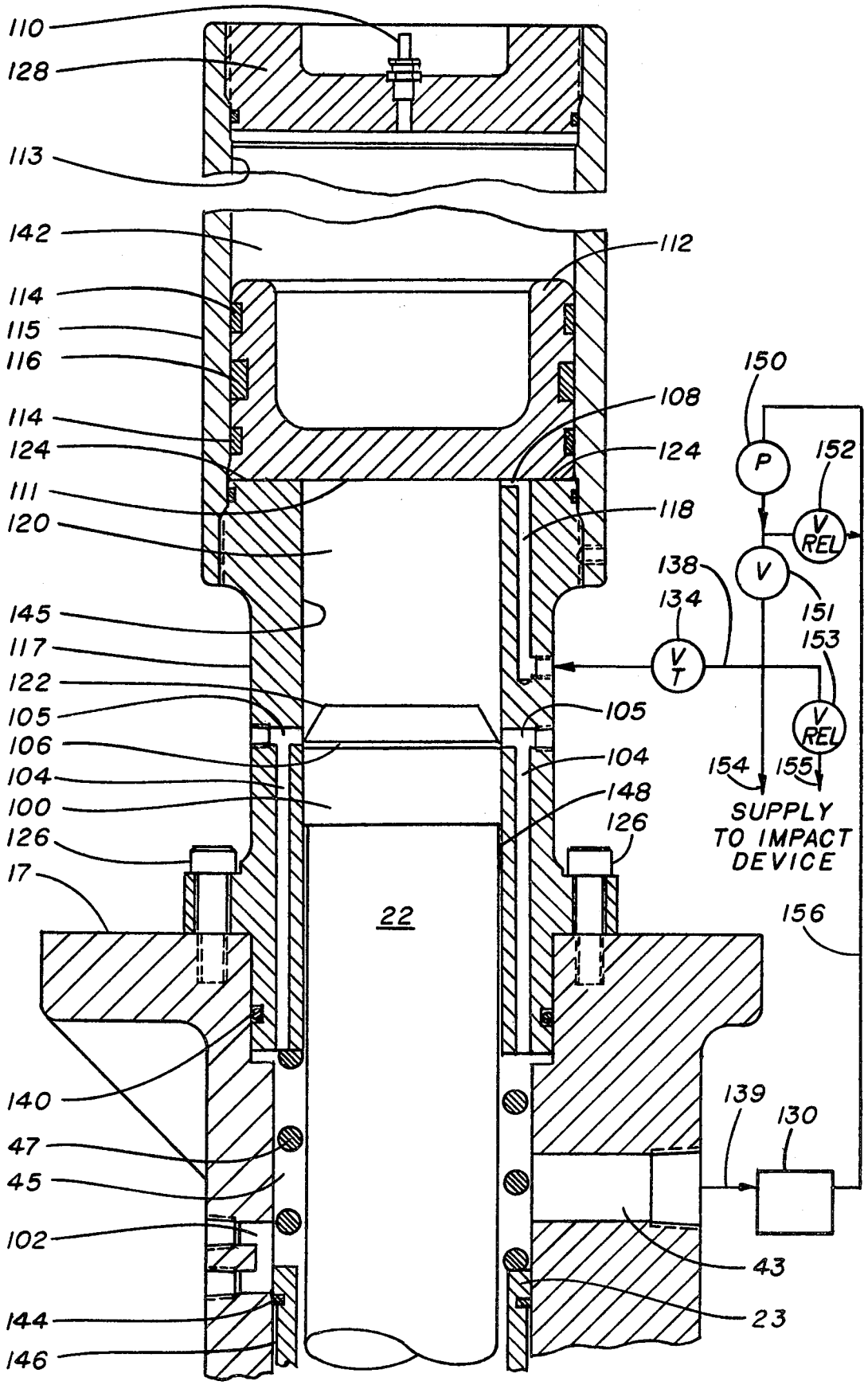
110
128
113
142
112
114
115
116
150
108
114
124
124
152
P
111
118
120
V
REL
138
V
134
151
153
145
V
T
117
122
105
105
V
REL
106
104
154
155
104
148
100
SUPPLY
TO IMPACT
DEVICE
126
126
17
22
156
140
139
130
47
45
102
43
144
23
146

ACTUATOR FOR A HYDRAULIC IMPACT DEVICE

BACKGROUND OF THE INVENTION

This invention relates to hydraulic hammers of a type used to break up concrete, street pavement, building walls and the like. More particularly, it relates to a linear actuator for providing the impacting force on the moil of hydraulic hammers and similar impact devices. Even though this invention relates specifically to an actuator for impact devices, it might be useful to understand the construction and operation of an impact device per se, such as a hydraulic hammer, in order to more fully appreciate this invention. Therefore, the entire teaching of my U.S. Pat. No. 4,231,434, issued Nov. 4, 1980, is incorporated herein by reference, and many two digit numerals therein are also used to designate corresponding parts in this invention.

A problem with prior impact devices resides in the manner force is applied to the ram which strikes the moil. Specifically, an air spring or chamber of compressed gas forces a metal plate, which forms a reciprocating wall of a chamber, directly against the ram head to produce the desired energy of the ram against the moil and thence against the target material. This impact force of the ram against the moil often also produces a re-vibratory reaction force by the ram head back against the driven plate. Repeated operation of such equipment causes metal fatigue in the plate contacting the ram head resulting in unwanted down time, maintenance and a shortened working life of the plate and ram.

SUMMARY OF THE INVENTION

This invention obviates metal fatigue between the ram head and piston by separating them with a column of hydraulic fluid at all times during operation so there is never any metal-to-metal contact between them. This permits the piston to be constructed less massively so more energy can be transmitted to the ram. Further, by making the piston diameter greater than the diameter of the ram head, the hydraulic fluid is accelerated as it travels downwardly into the ram cylinder chamber during the power stroke, thereby permitting lower velocity of the piston and much longer seal life. The kinetic energy imparted to the piston is also much less because of its lower velocity.

This configuration also utilizes the hydraulic fluid as a damper cushion between the piston and the ram to prolong equipment life.

Finally, the design includes an opening in the ram cylinder at the level of the top of the ram near the bottom of the ram stroke which permits the hydraulic fluid to escape. This causes the force applied to the ram face to be released virtually instantaneously at the point during ram travel where it is no longer needed so as to impart only kinetic energy to the ram and not to push with the ram against the moil. It is desirable to eliminate the push effect because it reacts to cause movement and operator discomfort on the carrying vehicle.

Accordingly, it is an object of this invention to provide an actuator suitable for use with an impact hammer wherein metal fatigue between the actuator and hammer ram is eliminated.

Another object is to provide an actuator for an impact hammer wherein metal-to-metal contact between the actuator and the ram of the hammer is eliminated.

Still another object is to provide an actuator for an impact hammer wherein a maximum percentage of the potential energy put into the actuator is converted into kinetic energy to drive the ram in the impact hammer.

A feature and advantage of this invention is the utilization of the same hydraulic fluid to both transmit power to the moil and cushion the end of the piston stroke.

Another advantage of the invention is the use of the same hydraulic fluid which drives the ram to dissipate shock waves returning from the moil upon striking the target.

These and other objects, features and advantages of this invention will be more readily understood and appreciated when the description of the preferred embodiment is read in conjunction with the attached drawing and, to whatever extent is necessary, if any, by individuals, my U.S. Pat. No. 4,231,434 incorporated herein by reference.

BRIEF DESCRIPTION OF THE DRAWING

FIG. 1 is a front elevational view of the actuator in cross section. The upper part of the structure is on the top, and the lower part is on the bottom.

DESCRIPTION OF THE PREFERRED EMBODIMENT

As shown in FIG. 1, ram 22 is slidably disposed in hydraulic hammer housing 117 which is attached to the upper end of hammer housing 17 with cap screws 126 and hydraulically sealed relative thereto by seal 140. In order to simplify the design and manufacture of the apparatus, there is an annular clearance 148 between the ram and its bore 45 in the housing for substantially the entire length of the ram. At the ram head 100, there is a finish bearing fit between the ram and bore 145 for a relatively short length. This relatively short length of bearing surface is less expensive to manufacture, and facilitates assembly and operation. Annular clearance 148 and the hydraulic fluid chamber 120 above the tapered ram face 122 are separated and sealed with a piston ring 106.

A sleeve valve 23 is slidably mounted in the bore 45 and is biased downwardly (i.e. to the bottom in FIG. 1) by hydraulic pressure in annulus 146.

A piston housing 115 is attached to the upper end of hydraulic housing 117. Piston housing cylindrical bore 113, end plug 128, and piston 112 define a gas chamber 142 into which a suitable gas, such as nitrogen, is introduced through inlet valve 110 to pressurize the gas chamber to a suitably high pressure, such as about 1,000 psig, for example. The piston is slidably disposed within bore 113 and the pressure is maintained on the upper side of the piston by seals 114, 116.

Similarly, piston face 111 at its lowermost extension shown in FIG. 1, the tapered face 122 of ram head 100, and the bore 145 of the hydraulic hammer housing 117 define a cylindrical hydraulic chamber 120 which is axially aligned with gas chamber 142, piston 112 and ram 22.

An inlet conduit 118 in hydraulic hammer housing 117 links a hydraulic fluid inlet line 138 with the hydraulic chamber 120 via a slot 108 at the ring-like interface 124 between the matching flat surface contours of piston face 111 and the butt end of housing 117. A hydraulic relief conduit 104 in housing 117 links hydraulic chamber 120 with the bore of hammer housing 17. A sealing annulus 146, in the form of a cylindrical undercut in slide valve 23, links the annulus around the slide valve with bore 45 when annular seal 144 on the slide valve is positioned over bypass notch 102 in housing 17.

The bore 45 is hydraulically linked with the exterior of the apparatus through the outlet port 43 returning to a hydraulic fluid reservoir 130 through outlet line 139. The structural actuator thus comprises piston housing 115, piston 112, gas chamber 142, hydraulic hammer housing 117 and hydraulic fluid chamber 120. The operating actuator further includes gas in the gas chamber and liquid in chamber 120 which cooperates with the ram face 122. In the preferred embodiment, additional apparatus and design features, including inlet conduit 118, relief conduit 104, radial opening 105 are provided. Conduit 118 is fed with a small volume of hydraulic fluid preferably bled from the high pressure supply to the hammer, such as from pump 150 through an on/off valve 151. Pump 150 is protected by a relief valve 152 linked to reservoir 130 via line 156. Hydraulic fluid is supplied to the impact device via high pressure line 154 and a somewhat lower pressure line 155 through a relief valve 153. The pressure differential between lines 154, 155 is about 100–150 psig.

In operation, the lower end of slide valve 23 is hydraulically sealed relative to the ram by a ring-like seal when the moil is loaded against the target and pressed upwardly against ram 22 as shown and explained in my U.S. Pat. No. 4,231,434. Hydraulic pressure is exerted against slide valve 23 and ram 22. Seal 144 prevents hydraulic fluid from entering bore 45 through sealing annulus 146. This causes slide valve 23 and ram 22 to move upwardly together (i.e. toward the top as shown in FIG. 1). As ram 22 moves upwardly, piston ring 106 passes radial openings 105 and hydraulically seals chamber 120. Hydraulic chamber 120 is full of hydraulic fluid (oil) from flow through conduit 118 and vents to bore 45 through conduits 104.

Continued upward movement of ram 22 forces piston 112 upwardly within bore 113 under the hydraulic pressure of the sealed column of hydraulic fluid in chamber 120 which cannot back out against the higher pressure in line 138, and now flows into the lower part of bore 113 beneath piston 112. The upward movement of piston 112 compresses the gas in chamber 142 to create a source of potential energy therein.

When ram 22 has traveled upwardly a predetermined distance, such as about 3 inches, seal 144 on slide valve 23 passes over notch 102 and the hydraulic fluid pressure in sealing annulus 146 is released into bore 45 and discharge port 43 for recycling into reservoir 130. This release of pressure in annulus 146 also permits sleeve valve 23 to unseat, thereby releasing the hydraulic pressure moving ram 22 upwardly as explained and shown in my U.S. Pat. No. 4,231,434. With no upward force holding ram 22 at the upper end of hydraulic chamber 120, the pressure in the gas compressed by piston 112 accelerates the piston, the column of hydraulic fluid in chamber 120 and the ram downwardly. Thus, the potential energy in the gas is changed into kinetic energy in the piston and column of hydraulic fluid as the piston 112 moves downwardly in bore 113 and the hydraulic fluid is forced back into hydraulic chamber 120 to drive the ram 22 downwardly and provide the power stroke. Previously, the hydraulic fluid had been pushed by the ram face 122 up into the lower part of piston housing 115 from hydraulic fluid chamber 120. Owing to the mass and velocity ratios used, over 85% of the potential energy is converted into kinetic energy in the ram.

Movement of piston 112 downwardly in bore 113 causes ram 22 to accelerate because the diameter of piston bore 113 is larger than the diameter of ram bore 145 and, therefore, ram 22 must move a greater distance in the time it takes piston 112 to move a given distance in order to transmit a fixed amount of hydraulic fluid from the lower part of gas chamber 142 back into hydraulic fluid chamber 120. The ratio of movement is inversely proportional to the diameters squared of the piston and ram.

Piston 112 arrives at its lowermost position at the interface 124 with hydraulic housing 117 at the same time, or slightly before, the tapered end face 122 of the ram passes below radial opening 105 in the hydraulic housing 117. This produces two effects. First, the film of hydraulic fluid at interface 124 helps cushion, or snub, the contact of the piston face against the hydraulic housing. Secondly, when opening 105 is uncovered by ram head 100, the hydraulic pressure in chamber 120 is immediately released through relief conduit 104 and out discharge port 43. This effectively stops the downward force against the ram 22 just as the ram strikes the moil and the cycle can then begin again. It should be understood, however, that the hydraulic pressure within chamber 120 need not be released in order for the actuator to operate. In fact, if perfect seals could be provided, a finite quantity of hydraulic fluid could be maintained in chamber 120 without providing for replacement of leaking liquid. However, as explained below, it is preferred to provide a small flow of hydraulic fluid through chamber 120.

When the piston is being pushed up by the oil driven by the ram in chamber 120, there is a small flow of hydraulic fluid from the higher pressure line 138 into hydraulic fluid chamber 120 through throttling valve 134, inlet conduit 118 and slot 108. This purges chamber 120 of any air, foam or other gas that might be present so the chamber is maintained full of hydraulic fluid. This purging action also removes heat from the apparatus. It is important to maintain hydraulic fluid chamber 120 full of liquid, and this is achieved by having inlet line 138 supplying hydraulic fluid to chamber 120 to insure that upward movement of the ram will produce a corresponding upward movement of the piston and compression of the gas to create a source of potential energy and provide energy for the initial power stroke.

For purposes of illustration, preferred typical operating parameters, flow rates and pressures are as follows: The nitrogen gas in gas chamber 142 is about 700 to 1,000 psig before being compressed by upward movement of piston 112. The fluid, preferably hydraulic oil, but in all circumstances a liquid, entering chamber 120 through slot 108 is at approximately 1.5 gallons/minute from a source at about 1500 to 1800 psig. Upstream of throttling valve 134, the hydraulic oil pressure is 1700 to 1850 psig typically. The pressure of the hydraulic fluid returning to the reservoir through outlet port 43 and outlet line is about 50–100 psig. For a ram head diameter of 3.25 inches and a piston diameter of 6 inches, the piston would travel somewhat less than 0.88 inches (allowing for gas compression) to produce a ram power stroke of 3 inches. The compression ratio of the gas in chamber 142 upon movement of the piston from its lowermost to its uppermost position is about 1.05. The ram strikes a hammer or tool, such as a moil, to provide the desired work.

The uppermost extension of the ram face in the hydraulic chamber is always beneath the lowermost extension of the piston face so there is always a column of liquid (hydraulic fluid) separating them to preclude damaging metal-to-metal contact during operation. This column of hydraulic fluid effectively functions as an "oil tappet" on the ram face in that it transmits work from the piston to the ram. The volume created in the piston bore beneath the piston as it is pushed upwardly functions as an accumulator for the hydraulic fluid before it is returned to the hydraulic chamber during the power stroke.

Elimination of a reciprocating plate, such as is used in conjunction with an air spring source of potential energy on prior devices, and the utilization of a moving quantity of hydraulic fluid bearing directly against the ram head provides substantial operating efficiencies as well as advantages. For example, in a typical air spring driven hydraulic hammer, the driver plate may weigh 15 pounds and the ram may weigh 70 pounds. In such a case, a substantial percentage of the air spring potential energy must be absorbed by the hammer housing to stop the driver plate and this energy is, therefore, unavailable to the ram. In this invention, there is no driver plate, so there is no need for the piston to be massive to withstand repeated blows against a driver plate. Accordingly, the piston is lighter than prior pistons, and less energy is needed to overcome the greater inertia of the piston when the piston is driven downwardly. Also, the necessity of stopping and absorbing the kinetic energy of a high velocity driven plate on each power stroke is avoided, which in turn obviates consequent damage to the hammer assembly.

Thus, an actuator for providing the power to an impact device has been shown and described in detail. The actuator will operate on any ram equipped impact device which includes means for moving the ram upwardly in the hydraulic fluid chamber and for releasing the force moving the ram upwardly, thus permitting a downward power stroke of the ram. It has been described and illustrated in conjunction with my U.S. Pat. No. 4,231,434 solely to facilitate the understanding of this invention and to incorporate any material from the 4,231,434 patent, such as the description relating to the hydraulic sealing of the slide valve 23 relative to ram 22 to move the ram upwardly in the hydraulic chamber and the release of hydraulic pressure to permit the downward power stroke of the ram, which may be useful to an individual to more readily grasp the concept and application of this invention.

Clearly, various modifications of the preferred embodiment described and shown can be made without departing from the spirit and scope of the invention. For example, the means receiving the potential energy in chamber 142, such as the compressed gas, could take another form for storing energy, such as a compressed spring.

Also, the relief outlet for reducing the hydraulic pressure within the hydraulic chamber need not necessarily recycle liquid back to the reservoir. It could merely function to reduce the hydraulic pressure, when uncovered by the ram head, and permit the pump to bring the liquid and pressure within the hydraulic chamber back to desired levels when covered again by upward ram movement.

What is claimed is:

1. In an actuator for providing a sudden work stroke to an impact device which includes a hammer housing member, a ram slidably disposed in the hammer housing member for reciprocal movement therein, means for moving the ram upwardly in the hammer housing member, and means for releasing the means for moving the ram upwardly, the actuator including a hydraulic housing member for receiving at least one end of the ram, a piston housing in fluid communication with the hydraulic housing member, means within the piston housing for receiving potential energy therein, a piston face disposed within the piston housing and defining, together with the opposed face of the ram and the walls of the hydraulic housing member and piston housing, a hydraulic chamber for receiving liquid therein, wherein the improvement comprises:

a portion of the piston face and an upper portion of the hydraulic housing define an interface therebetween when the piston face is at its lowermost extension in the piston housing;

means for maintaining liquid at the interface to snub movement of the piston face toward the hydraulic housing;

opening means in the hydraulic housing, and associated with the ram, such that the openings remain sealed by the ram to thereby seal a finite quantity of liquid received in the hydraulic chamber and maintain a space between the piston face and ram, said liquid remaining sealed until at or about the time the release of potential energy has moved the piston face to its proximate interface position on its power stroke and the pressure thereby produced in the liquid has moved the ram to a corresponding lower position to essentially complete its power stroke, at which time the ram unseals the opening means to release the liquid pressure.

2. The actuator as set forth in claim 1, wherein:

the means for maintaining liquid at the interface includes means for supplying liquid to the hydraulic chamber to maintain said chamber full of liquid during the power and reciprocal strokes of the ram.

3. The actuator as set forth in claim 1, wherein:

the effective area of the piston face is greater than the effective area of the ram face whereby the liquid returning from the piston housing to the hydraulic housing causes the ram to move faster in its power stroke than the piston.

4. An actuator for providing a sudden finite length work stroke to an impact device which includes a hammer housing member, a ram slidably disposed in the hammer housing member for reciprocal movement therein, means for moving the ram upwardly in the hammer housing member, and means for releasing the means for moving the ram upwardly, the actuator comprising:

a hydraulic housing member for receiving at least one end of the ram from the hammer housing member for reciprocal movement from a lower position to an upper position therein;

a piston housing in fluid communication with the hydraulic housing member;

a piston movably disposed in the piston housing and having a face facing the end of the ram extending into the hydraulic housing member and defining, with said ram, piston and hydraulic housing members, a hydraulic chamber for receiving a liquid therein;

means for maintaining a compressible fluid in the piston housing, on the other side of the piston from the hydraulic chamber, for receiving potential energy therein;

the effective area of the piston face is greater than the effective area of the face of the ram extending into the hydraulic housing member;

a portion of the piston face and an upper portion of the hydraulic housing member define an interface therebetween when the piston face is at its lowermost extension in the piston housing;

means for maintaining liquid at the interface to snub movement of the piston face toward the hydraulic housing;

means in the hydraulic housing for relieving the liquid pressure providing the power stroke on the ram at essentially the time when the piston face is snubbed and the ram reaches its lowermost position;

whereby the piston face and ram face remain in spaced adjacency at all times during operation with liquid maintained therebetween, and upward movement of the ram causes movement of the liquid upwardly into the piston housing and a corresponding upward movement of the piston face in the piston housing and an increase in potential energy in the compressible fluid which is released through the piston face to the liquid and ram upon release of the means for effecting movement of the ram upwardly in the hammer housing member.

5. The actuator as set forth in claim 4, wherein:

the volume of the hydraulic liquid accumulator portion of the piston housing between the lower and upper positions of the piston face therein being less than the volume of the hydraulic chamber between the lower position of the ram face and the lower position of the piston face.

6. The actuator as set forth in claim 4, wherein:

the lowermost position of the piston face extends to an adjacent surface of the hydraulic housing member having a substantially matching surface contour over a portion of the piston face whereby hydraulic fluid between their surfaces functions to cushion their movement together.

* * * * *